US009943983B2

(12) United States Patent
LaCroix et al.

(10) Patent No.: US 9,943,983 B2
(45) Date of Patent: Apr. 17, 2018

(54) BLOCK SPLITTER ASSEMBLY AND METHOD OF PRODUCING WALL BLOCKS

(71) Applicants: David M. LaCroix, Eagan, MN (US); Kyle Bakner, Hedgeville, WV (US)

(72) Inventors: David M. LaCroix, Eagan, MN (US); Kyle Bakner, Hedgeville, WV (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 35 days.

(21) Appl. No.: 15/264,895

(22) Filed: Sep. 14, 2016

(65) Prior Publication Data

US 2017/0072593 A1 Mar. 16, 2017

Related U.S. Application Data

(60) Provisional application No. 62/218,793, filed on Sep. 15, 2015.

(51) Int. Cl.
*B28D 1/22* (2006.01)
*B28D 1/26* (2006.01)

(52) U.S. Cl.
CPC ..... *B28D 1/222* (2013.01); *B28D 1/22* (2013.01); *B28D 1/26* (2013.01)

(58) Field of Classification Search
CPC ..... B28D 1/22; B28D 1/222; B28D 1/26
USPC ..... 125/23.01, 40
See application file for complete search history.

(56) References Cited

U.S. PATENT DOCUMENTS

| | | | | |
|---|---|---|---|---|
| 1,004,193 | A | 9/1911 | Plaisted | |
| 2,881,753 | A | 4/1959 | Entz | |
| 2,925,080 | A | 2/1960 | Smith | |
| 3,392,719 | A | 7/1968 | Clanton et al. | |
| 4,114,773 | A | 9/1978 | Sekiguchi | |
| 4,250,863 | A | 2/1981 | Gagnon et al. | |
| 6,029,943 | A | 2/2000 | Sievert | |
| 6,050,255 | A * | 4/2000 | Sievert | B28B 17/0018 125/23.01 |

(Continued)

FOREIGN PATENT DOCUMENTS

| | | |
|---|---|---|
| EP | 0 294 267 A1 | 12/1988 |
| GB | 924290 A | 4/1963 |

(Continued)

OTHER PUBLICATIONS

Sep. 3, 2008 Notification of Transmittal of the International Search Report and the Written Opinion of the International Searching Authority, or the Declaration in International Application No. PCT/US2008/065921 (16 pages).

(Continued)

*Primary Examiner* — Eileen Morgan
(74) *Attorney, Agent, or Firm* — Popovich, Wiles & O'Connell, P.A.

(57) ABSTRACT

The invention provides a block splitter device comprising first lower and second upper opposed block splitter assemblies. The block splitter assemblies have first and second forming edges that extend at least the majority of the distance from a first end to a second end of the block splitter assembly and have first ends disposed near a median split plane and second ends disposed further away from the median split plane than the first ends. Methods of using the block splitter device are described.

25 Claims, 9 Drawing Sheets

(56) References Cited

U.S. PATENT DOCUMENTS

| | | | | |
|---|---|---|---|---|
| 6,082,057 | A | 7/2000 | Sievert | |
| 6,178,704 | B1 | 1/2001 | Sievert | |
| 6,321,740 | B1 | 11/2001 | Scherer et al. | |
| 6,681,756 | B1 * | 1/2004 | Kilpatrick | B25D 17/02 125/23.01 |
| 6,827,073 | B1 * | 12/2004 | Morrell | B28D 1/222 125/12 |
| 6,874,494 | B2 | 4/2005 | Scherer et al. | |
| 6,886,551 | B2 | 5/2005 | Scherer et al. | |
| 6,910,474 | B1 | 6/2005 | Scherer | |
| 6,918,715 | B2 * | 7/2005 | Scherer | B28B 7/0085 125/23.01 |
| 6,964,272 | B2 | 11/2005 | Scherer | |
| 7,004,158 | B2 | 2/2006 | Scherer et al. | |
| 7,066,167 | B2 | 6/2006 | Scherer et al. | |
| 7,146,974 | B2 | 12/2006 | Scherer | |
| 7,428,900 | B2 | 9/2008 | Scherer | |
| 8,302,591 | B2 | 11/2012 | LaCroix | |
| 8,448,634 | B2 | 5/2013 | LaCroix | |
| 8,701,647 | B2 | 4/2014 | LaCroix | |
| 8,701,648 | B2 | 4/2014 | LaCroix | |
| 2002/0092257 | A1 * | 7/2002 | Scherer | B28B 7/0085 52/596 |
| 2003/0089363 | A1 | 5/2003 | Suto et al. | |
| 2004/0200468 | A1 * | 10/2004 | Scherer | B28B 17/0027 125/23.01 |
| 2005/0268901 | A1 | 12/2005 | Scherer | |
| 2006/0027226 | A1 | 2/2006 | Sorheim | |
| 2006/0054154 | A1 * | 3/2006 | Scherer | B28D 1/006 125/23.01 |
| 2006/0169270 | A1 | 8/2006 | Scherer et al. | |
| 2008/0047539 | A1 | 2/2008 | Scherer et al. | |
| 2008/0092870 | A1 * | 4/2008 | Karau | B28D 1/222 125/23.01 |
| 2008/0096471 | A1 * | 4/2008 | Karau | B28D 1/222 451/41 |
| 2008/0135035 | A1 | 6/2008 | Scherer | |
| 2008/0302350 | A1 * | 12/2008 | LaCroix | B28B 17/0027 125/23.01 |
| 2014/0090632 | A1 | 4/2014 | LaCroix | |
| 2016/0303763 | A1 | 10/2016 | LaCroix et al. | |

FOREIGN PATENT DOCUMENTS

| | | | |
|---|---|---|---|
| GB | 1 509 747 | A | 5/1978 |
| WO | WO 2004/091879 | A1 | 10/2004 |

OTHER PUBLICATIONS

Abstract for EP 0 294 267 A1 (2 pages).

* cited by examiner

BLOCK SPLITTER ASSEMBLY AND METHOD OF PRODUCING WALL BLOCKS

This application claims the benefit of U.S. Provisional Application No. 62/218,793, filed Sep. 15, 2015, entitled "Block Splitter Assembly and Method of Producing Wall Blocks", the contents of which are hereby incorporated by reference.

FIELD OF THE INVENTION

The invention relates generally to the manufacture of concrete wall blocks. More specifically, it relates to equipment and processes for the creation of faces on concrete wall blocks, especially a block splitter assembly.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound and easy and relatively inexpensive to install. Because they are made of concrete, they are durable. They can be given a desired appearance such as, for example, natural stone.

Typically, retaining wall blocks are manufactured to have the desired appearance on the front face (i.e., the outer face of a wall) because only the front is visible after the wall is constructed. It is highly desirable to have the front face of the wall system have a natural stone appearance, and many approaches are used in the art to treat or process concrete to evoke the appearance of natural stone, including splitting the block, tumbling the block to weather the face and edges of the face, and using processing or texturing equipment to impart a weathered look to the concrete. Typically, blocks are formed as mirror image pairs joined at a front face which are then subsequently split using a block splitter, as known in the art, to provide a rough appearing front surface on the split blocks.

Automated equipment to split block is well-known, and generally includes a splitting apparatus comprising a supporting table and opposed, hydraulically-actuated splitting blades. A splitting blade is typically a substantial steel plate that is tapered to a relatively narrow or sharp knife edge. The blades typically are arranged so that the knife edges will engage the top and bottom surfaces of the workpiece in a perpendicular relationship with those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cracks) generally along the plane of alignment of the blades. These machines are useful for the high-speed processing of blocks. They produce an irregular, rock-face finish on the blocks. Because no two faces resulting from this process are identical, the blocks are more natural in appearance than standard, non-split blocks.

There is a need for a block splitter assembly that provides a more complex form to the block than existing block splitter devices.

SUMMARY OF THE INVENTION

The invention provides a block splitter device comprising first lower and second upper opposed block splitter assemblies. The block splitter assemblies have first and second forming edges that extend at least the majority of the distance from a first end to a second end of the block splitter assembly and have first ends disposed near a median split plane and second ends disposed further away from the median split plane than the first ends. Methods of using the block splitter device are described.

It is to be understood that both the foregoing general description and the following detailed description are exemplary and explanatory and are intended to provide further explanation of the invention as claimed.

DETAILED DESCRIPTION OF THE PREFERRED EMBODIMENTS

The invention relates to devices and methods for the splitting of concrete wall block workpieces to create complex appearances in the faces of concrete retaining wall blocks that result from splitting the workpieces. The invention may be used with any variety of blocks molded or formed through any variety of processes.

Figure 1:
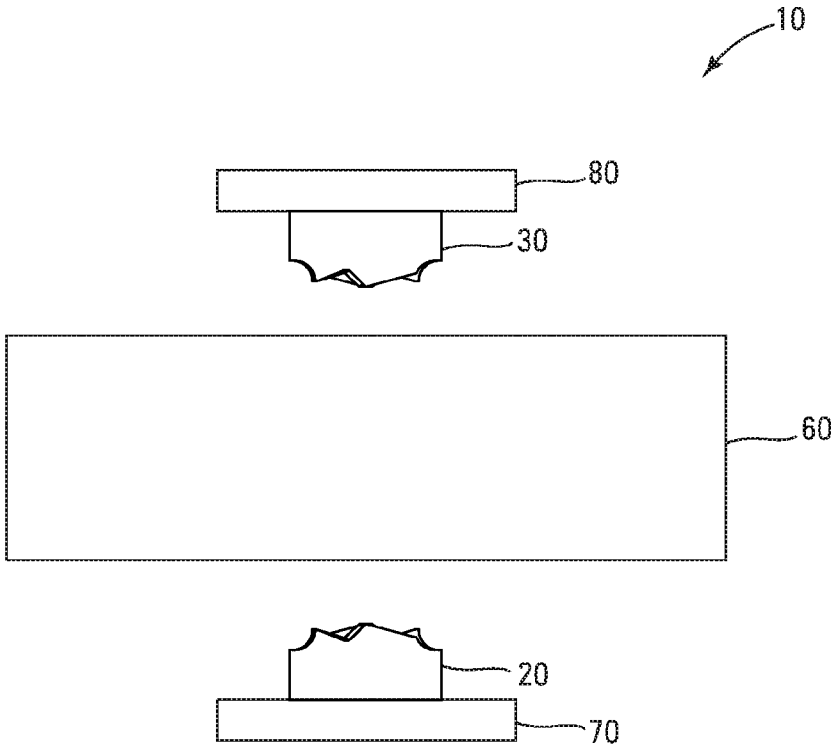
FIG. 1 is an end view of a block splitter device positioned to split a workpiece.

In FIG. 1, a block splitter device in accordance with invention is depicted, in part, showing in particular an end view of block splitter device 10. Block splitter device 10 has opposed first 20 and second 30 block splitter assemblies. The first or lower block splitter assembly 20 is positioned at the bottom of the block splitter device 10. The first block splitter assembly 20 is attached to the bottom mounting plate 70 of the block splitter device 10.

An upper or second splitter blade assembly 30 may also be seen in FIG. 1. The second block splitter assembly 30 is attached to the top mounting plate 80 of the block splitter device 10. A workpiece 60 is shown in FIG. 1. The position of the workpiece 60 within the block splitter device 10 is shown in FIG. 1 in the ready-to-split position.

Figure 2:
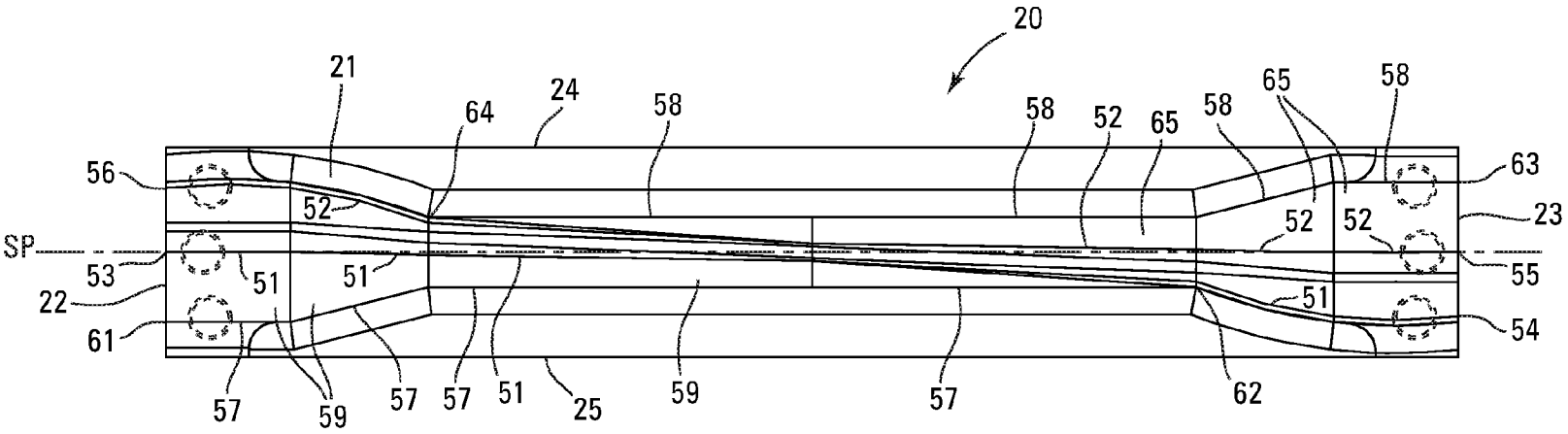
FIG. 2 is a top view of a first block splitter assembly of FIG. 1.
Figure 3:
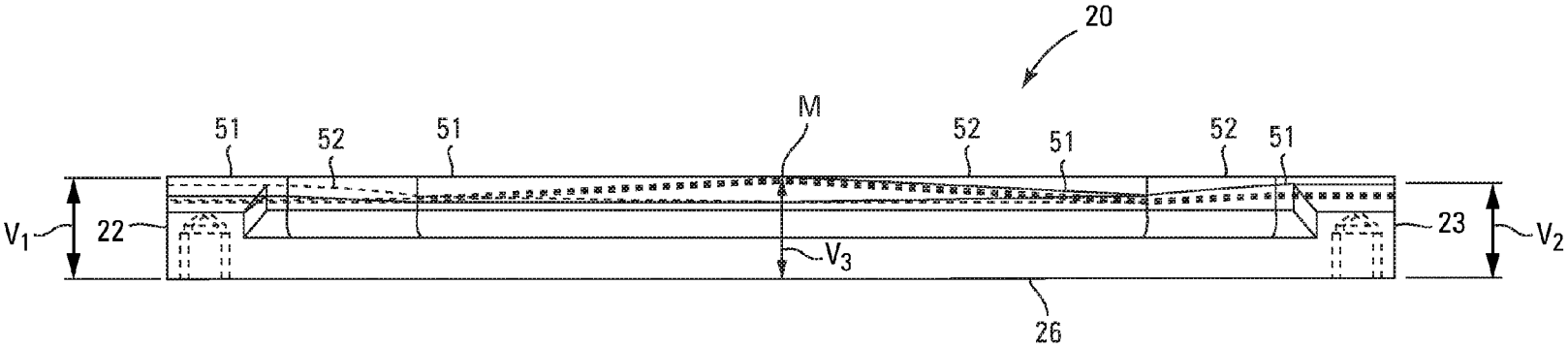
FIG. 3 is a side view of the first block splitter assembly of FIG. 1.

FIG. 2 is a top view of the first block splitter assembly 20. As seen in FIGS. 2 and 3, the first block splitter assembly has a top surface 21, bottom surface 26, opposed end surfaces 22 and 23, respectively, and opposed first and second side surfaces 24 and 25, respectively. First block splitter assembly 20 has first forming edge 51 and second forming edge 52. First forming edge 51 has first end 53 and second end 54 and extends from first end 22 to second end 23 of the first block splitter assembly 20. The first end 53 of the first forming edge 51 is disposed at first end 22 of the first block splitter assembly 20 and is disposed at the median split plane SP. The median split plane SP is a reference plane that divides the top surface 21 and the bottom surface 26 of the first block splitter assembly 20 in half and intersects a midpoint between the first 24 and second 25 side surfaces of the first end 22 of the first block splitter assembly 20 and intersects a midpoint between the first 24 and second 25 side surfaces of the second end 23 of the first block splitter assembly 20. The second end 54 of the first forming edge 51 is disposed at the second end 23 of the first block splitter assembly 20 and is disposed away from the median split plane SP. The minimum distances between the first forming edge 51 and the median split plane SP increase or remain constant over the entire length of the first forming edge 51 from the first end 53 to the second end 54 of the first forming edge 51.

Second forming edge 52 has first end 55 and second end 56 and extends from first end 22 to second end 23 of the first block splitter assembly 20. The first end 55 of the second forming edge 52 is disposed at second end 23 of the first block splitter assembly 20 and is disposed at the median split plane SP. The second end 56 of the second forming edge 52 is disposed at the first end 22 of the first block splitter assembly 20 and is disposed away from the median split plane SP. The minimum distances between the second forming edge 52 and the median split plane SP increase or remain constant over the entire length of the second forming edge 52 from the first end 55 to the second end 56 of the second forming edge 52.

FIG. 3 is a side view of the first block splitter assembly 20 showing that the first forming edge 51 of the first block splitter assembly 20 has a vertical dimension $V_1$ at its first end 53 and a vertical dimension $V_2$ at its second end 54, and the vertical dimension $V_1$ of the first forming edge 51 at its first end 53 is greater than the vertical dimension $V_2$ at its second end 54. The second forming edge 52 of the first block splitter assembly 20 has a vertical dimension $V_1$ at its first end 55 and a vertical dimension $V_2$ at its second end 56, and the vertical dimension $V_1$ of the second forming edge 52 at its first end 55 is greater than the vertical dimension $V_2$ at its second end 56. As shown in FIG. 3, $V_1$ is illustrated at first end 22 and $V_2$ is illustrated at second end 23, as would be the case for first forming edge 51. For second forming edge 52, $V_1$ would be located at second end 23 and $V_2$ would be located at first end 22.

As shown in FIG. 3, the first forming edge 51 of the first block splitter assembly 20 has a vertical dimension $V_3$ at the midpoint M between the first 22 and second 23 ends of the first block splitter assembly 20, and the vertical dimension $V_3$ of the first forming edge 51 at its midpoint M is greater than the vertical dimension $V_2$ at its second end 54. The second forming edge 52 of the first block splitter assembly 20 has a vertical dimension $V_3$ at the midpoint M between the first 22 and second 23 ends of the first block splitter assembly 20, and the vertical dimension $V_3$ of the second forming edge 52 at its midpoint M is greater than the vertical dimension $V_2$ at its second end 56. As shown in FIG. 2, the first forming edge 51 and the second forming edge 52 extend in an arc for a portion of a length from their first to second ends.

As shown in FIG. 2, the top surface 21 of the first block splitter assembly 20 further comprises a third forming edge 57 having a length and extending the majority of the distance from the first end 22 to the second end 23 of the first block splitter assembly 20. The third forming edge 57 has a first end 61 and a second end 62, and the first end 61 of the third forming edge 57 is disposed closer to the first end 22 of the first block splitter assembly 20 than the second end 23 of the first block splitter assembly 20. The second end 62 of the third forming edge 57 is disposed closer to the second end 23 of the first block splitter assembly 20 than the first end 22 of the first block splitter assembly 20 and is disposed closer to the median split plane SP than the first end 61 of the third forming edge 57. The third forming edge 57 is disposed further away from the median split plane SP than the first forming edge 51 for the length of the third forming edge 57 and the third forming edge 57 is disposed further away from second forming edge 52 than the first forming edge 51 for the length of the third forming edge 57.

The top surface 21 of the first block splitter assembly 20 further comprises a fourth forming edge 58 having a length and extending the majority of the distance from the first end 22 to the second end 23 of the first block splitter assembly 20. The fourth forming edge 58 has a first end 63 and a second end 64, and the first end 63 of the fourth forming edge 58 is disposed closer to the second end 23 of the first block splitter assembly 20 than the first end 22 of the first block splitter assembly 20. The second end 64 of the fourth forming edge 58 is disposed closer to the first end 22 of the first block splitter assembly 20 than the second end 23 of the first block splitter assembly 20 and is disposed closer to the median split plane SP than the first end 63 of the fourth forming edge 58. The fourth forming edge 58 is disposed further away from the median split plane SP than the second forming edge 52 for the length of the fourth forming edge 58 and the fourth forming edge 58 is disposed further away from the first forming edge 51 than the second forming edge 52 for the length of the fourth forming edge 58. The fourth forming edge 58 is disposed further away from the third forming edge 57 than from both the first 51 and second 52 forming edges for the length of the fourth forming edge 58.

As shown in FIG. 2, the top surface 21 of the first block splitter assembly 20 comprises a first forming surface 59 extending between the third forming edge 57 and the first forming edge 51 and a second forming surface 65 extending between the fourth forming edge 58 and the second forming edge 52.

The second block splitter assembly 30 is identical to the first block splitter assembly 20 except for its orientation relative to the workpiece 60. For example, the bottom surface of the first block splitter assembly is the top surface of the second block splitter assembly; the top forming surface of the first block splitter assembly is the bottom forming surface of the second block splitter assembly.

Figure 4:
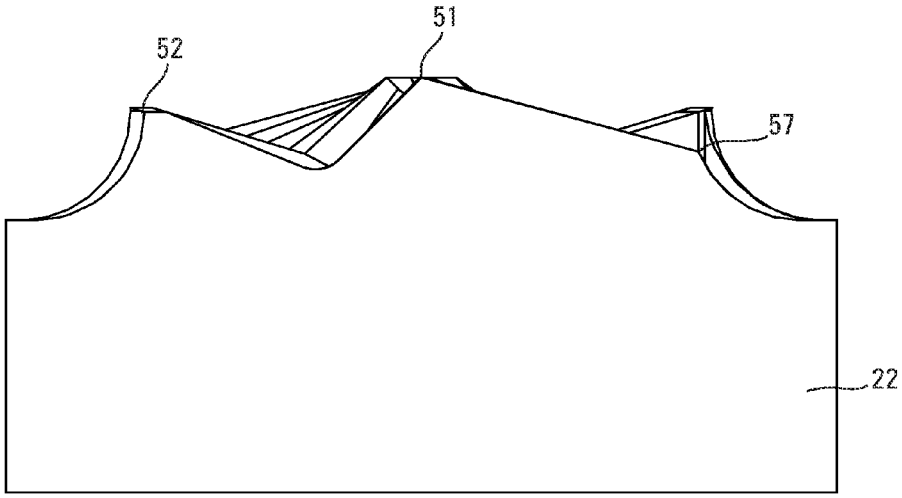
FIG. 4 is an end view of the first block splitter assembly of FIG. 1.
Figure 5:
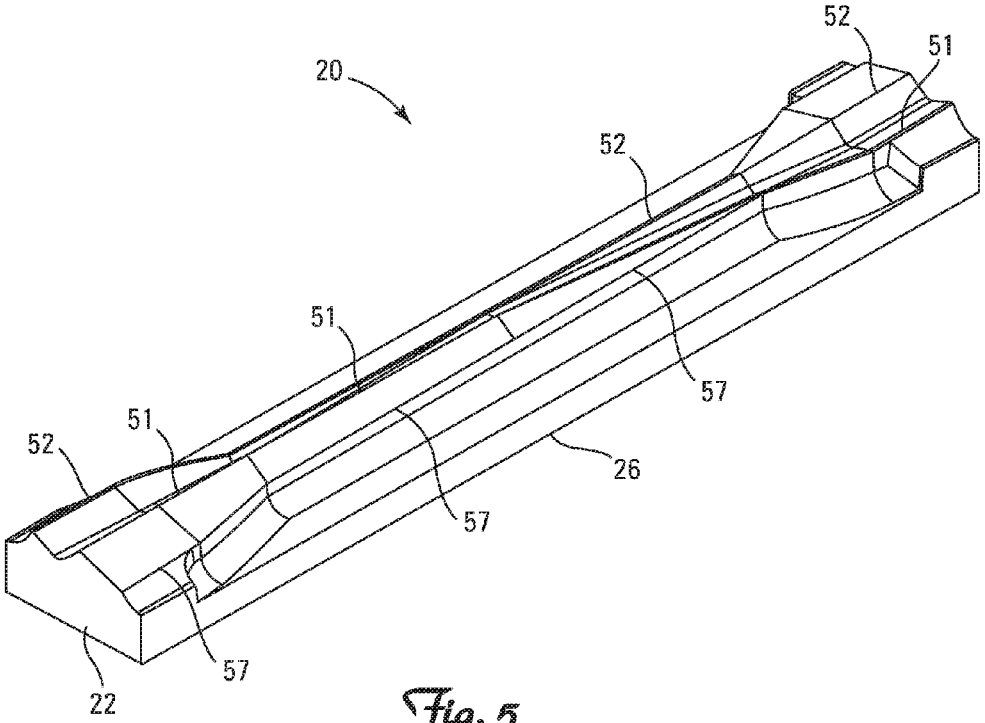
FIG. 5 is a perspective view of the first block splitter assembly of FIG. 1.

FIG. 4 is an end view of the first block splitter assembly 20 of FIG. 1. FIG. 5 is a perspective view of the first block splitter assembly 20 of FIG. 1.

Figure 6:
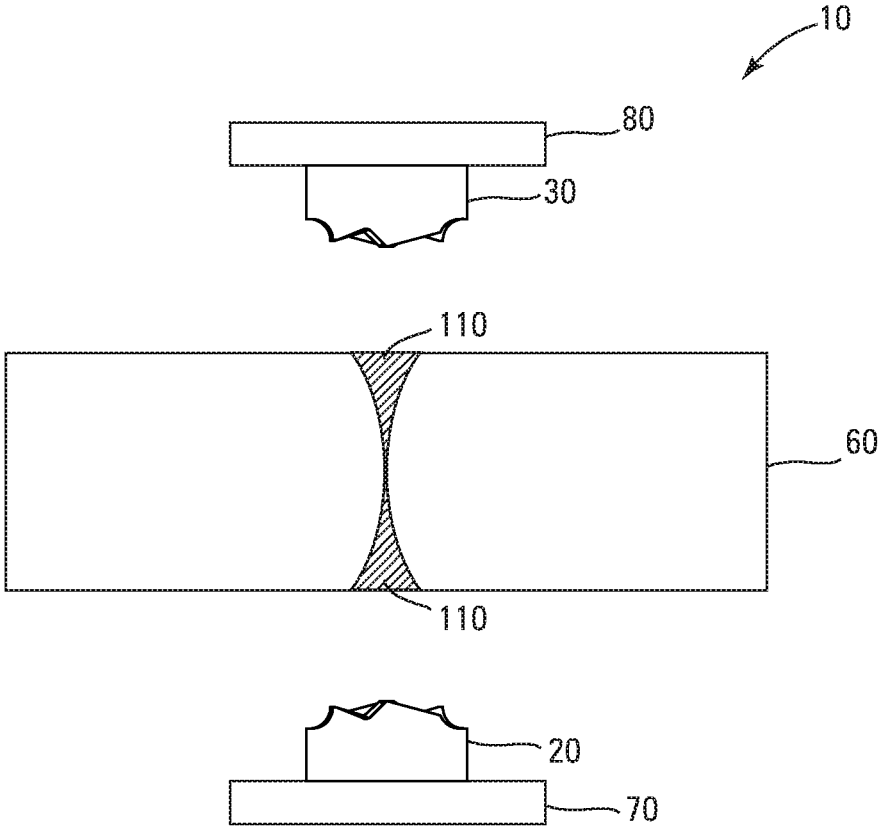
FIG. 6 is an end view of the block splitter device of FIG. 1 with the workpiece in the ready-to-split position.

FIG. 6 is an end view of the block splitter device 10 with the workpiece 60 in the ready-to-split position. The workpiece 60 is shown with removed portions 110 (shaded). When the workpiece 60 is split using the block splitter assembly 10, the workpiece breaks in two and the removed portions 110 are also produced.

Figure 7:
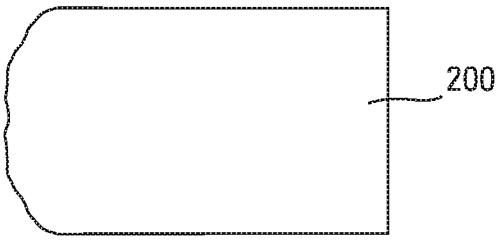
FIG. 7 is a side view of a block produced from the workpiece 60 by the block splitter device of FIG. 1.

FIG. 7 shows a side view of a block 200 produced from the workpiece 60 by the block splitter device 10.

In operation, the workpiece 60 is generally centered in the block splitter according to known practices as seen in FIGS. 1 and 6. The block splitter device 10 is then activated resulting in the first and second opposing block splitter assemblies 20, 30 converging on, and striking, the workpiece 60. The first and second block splitter assemblies preferably may travel anywhere from about ⅝ to one inch (1.59 to 2.54 cm) into the top and bottom surfaces of the workpiece 60. The workpiece 60 is then split as shown in FIG. 6. However, it is possible and within the scope of the invention to split the workpiece into more than two pieces. Generally, the splitter assemblies act on the block with a pressure ranging from about 600 to 1000 psi (42.2 to 70.3 $kg/cm^2$), and preferably about 750 to 800 psi (52.7 to 56.2 $kg/cm^2$).

Figure 8:
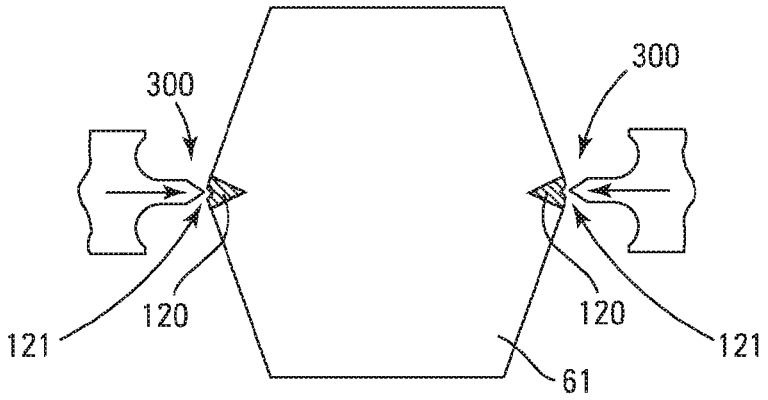
FIG. 8 is a top view of side knife assemblies and a workpiece.
Figure 9:
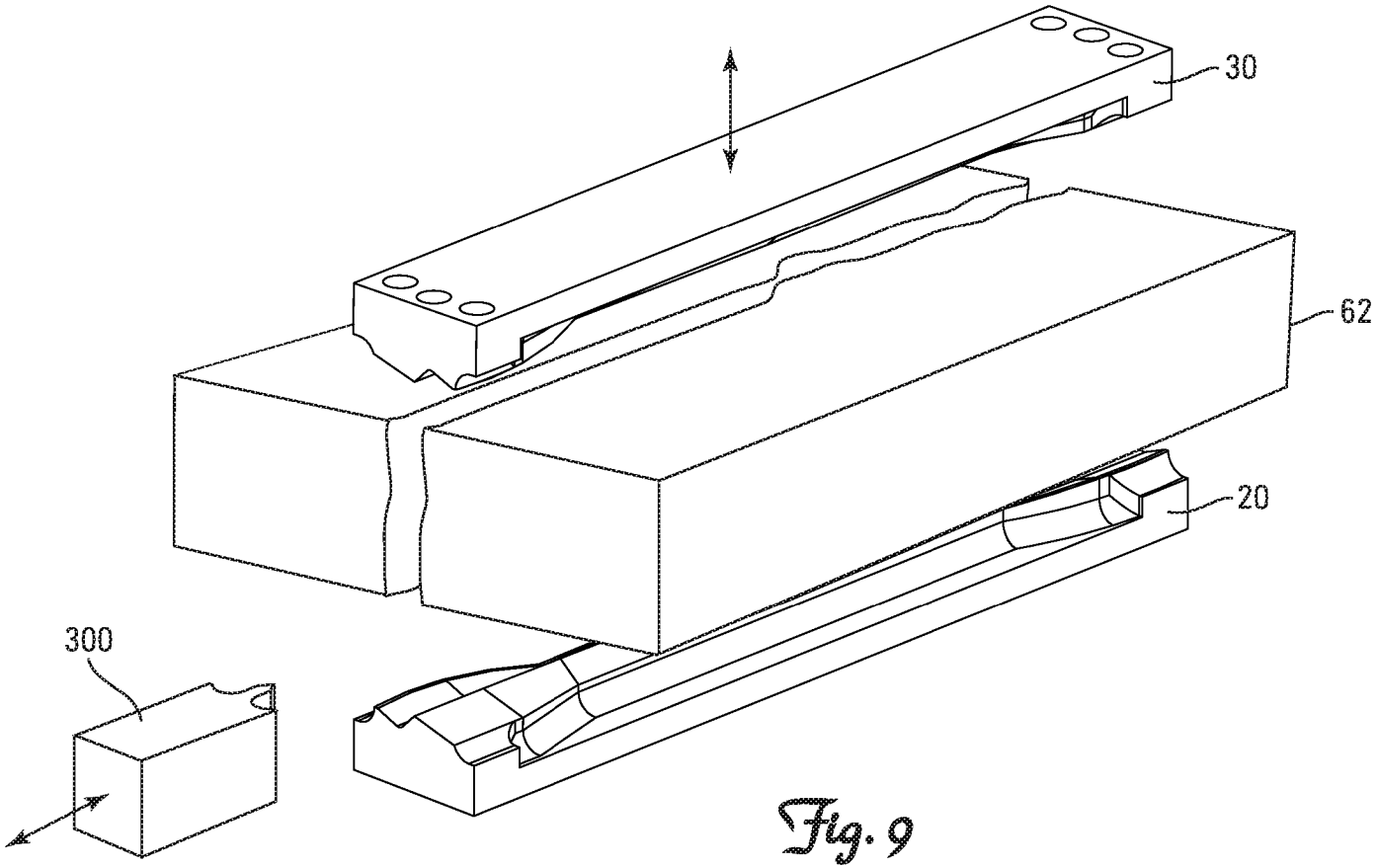
FIG. 9 is a perspective view of a side knife assembly, opposed first lower and second upper block splitter assemblies, and a workpiece.

As will be well understood by one of skill in the art, the splitter device may include opposed hydraulically activated side knife assemblies which preferably impinge upon the block with the same timing and in the same manner as the opposed first and second block splitter assemblies 20, 30. The side knife assemblies could be formed similarly to the first and second block splitter assemblies 20, 30 to produce similar removed portions. In addition, variations in the block splitter assemblies could be used to produce blocks having removed portions on just the top and bottom of the face of a block, the top and bottom and sides, the top and sides, or the sides only. FIG. 8 shows a top view of side knife assemblies 300, workpiece 61, and removed portions 120. In addition, side knife assemblies 300 may be used to align and index workpiece 61 prior to using block splitter assemblies 20, 30. To achieve this alignment, vertical side notches 121 in the workpiece 61 can be engaged by the front portion of side knife assemblies 300 to hold in a specified position, but are not used to actually split the workpiece. FIG. 9 shows a perspective view of a side knife assembly 300, side knife assembly 301 (not shown, opposite side knife assembly 300), opposed first lower and second upper block splitter assemblies 20, 30 and workpiece 62.

More generally, the invention provides a block splitter device having a block splitter assembly. The block splitter assembly comprises a first end opposed from a second end, a first side surface opposed from a second side surface, a top surface, and a bottom surface. The top surface comprises: (i) a first forming edge extending at least the majority of the distance from the first end to the second end of the first block splitter assembly, the first forming edge having a first end and a second end, the first end of the first forming edge being disposed closer to the first end of the first block splitter assembly than the second end of the first block splitter assembly and being disposed near a median split plane, the median split plane being a reference plane that divides the top surface and the bottom surface of the first block splitter assembly in half and intersects a midpoint between the first and second side surfaces of the first end of the first block splitter assembly and intersects a midpoint between the first and second side surfaces of the second end of the first block splitter assembly, the second end of the first forming edge being disposed closer to the second end of the first block splitter assembly than the first end of the first block splitter assembly and being disposed further away from the median split plane than the first end of the first forming edge. The top surface also comprises (ii) a second forming edge extending at least the majority of the distance from the first end to the second end of the first block splitter assembly, the second forming edge having a first end and a second end, the first end of the second forming edge being disposed closer to the second end of the first block splitter assembly than the first end of the first block splitter assembly and being disposed near the median split plane, the second end of the second forming edge being disposed closer to the first end of the first block splitter assembly than the second end of the first block splitter assembly and being disposed further away from the median split plane than the first end of the second forming edge.

The invention provides a block splitter device comprising first lower and second upper opposed block splitter assemblies. The first block splitter assembly comprises a first end opposed from a second end, a first side surface opposed from a second side surface, a top surface, and a bottom surface, the top surface comprising: (i) a first forming edge extending at least the majority of the distance from the first end to the second end of the first block splitter assembly, the first forming edge having a first end and a second end, the first end of the first forming edge being disposed closer to the first end of the first block splitter assembly than the second end of the first block splitter assembly and being disposed near a median split plane, the median split plane being a reference plane that divides the top surface and the bottom surface of the first block splitter assembly in half and intersects a midpoint between the first and second side surfaces of the first end of the first block splitter assembly and intersects a midpoint between the first and second side surfaces of the second end of the first block splitter assembly, the second end of the first forming edge being disposed closer to the second end of the first block splitter assembly than the first end of the first block splitter assembly and being disposed further away from the median split plane than the first end of the first forming edge. The top surface also comprises (ii) a second forming edge extending at least the majority of the distance from the first end to the second end of the first block splitter assembly, the second forming edge having a first end and a second end, the first end of the second forming edge being disposed closer to the second end of the first block splitter assembly than the first end of the first block splitter assembly and being disposed near the median split plane, the second end of the second forming edge being disposed closer to the first end of the first block splitter assembly than the second end of the first block splitter assembly and being disposed further away from the median split plane than the first end of the second forming edge. The second block splitter assembly comprises a first end opposed from a second end, a first side surface opposed from a second side surface, a top surface, and a bottom surface, the bottom surface comprising: (i) a first forming edge extending at least the majority of the distance from the first end to the second end of the second block splitter assembly, the first forming edge having a first end and a second end, the first end of the first forming edge being disposed closer to the first end of the second block splitter assembly than the second end of the second block splitter assembly and being disposed near a median split plane, the median split plane being a reference plane that divides the top surface and the bottom surface of the second block splitter assembly in half and intersects a midpoint between the first and second side surfaces of the first end of the second block splitter assembly and intersects a midpoint between the first and second side surfaces of the second end of the second block splitter assembly, the second end of the first forming edge being disposed closer to the second end of the second block splitter assembly than the first end of the second block splitter assembly and being disposed further away from the median split plane than the first end of the first forming edge. The bottom surface also comprises (ii) a second forming edge extending at least the majority of the distance from the first end to the second end of the second block splitter assembly, the second forming edge having a first end and a second end, the first end of the second forming edge being disposed closer to the second end of the second block splitter assembly than the first end of the second block splitter assembly and being disposed near the median split plane, the second end of the second forming edge being disposed closer to the first end of the second block splitter assembly than the second end of the second block splitter assembly and being disposed further away from the median split plane than the first end of the second forming edge.

In one embodiment, in the first block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge, and in the second block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge.

In one embodiment, the first and second forming edges of the first block splitter assembly do not intersect and the first and second forming edges of the second block splitter assembly do not intersect. In an embodiment, the first and second forming edges of the first block splitter assembly extend the entire distance from the first end to the second end of the first block splitter assembly and the first and second forming edges of the second block splitter assembly extend the entire distance from the first end to the second end of the second block splitter assembly. In an embodiment, the first and second forming edges of the first block splitter assembly and the first and second forming edges of the second block splitter assembly are not opposed to each other.

In one embodiment, the first forming edge of the first block splitter assembly has a vertical dimension at its first end and a vertical dimension at its second end, and the vertical dimension of the first forming edge at its first end is greater than the vertical dimension at its second end, the second forming edge of the first block splitter assembly has a vertical dimension at its first end and a vertical dimension at its second end, and the vertical dimension of the second forming edge at its first end is greater than the vertical dimension at its second end, the first forming edge of the second block splitter assembly has a vertical dimension at its first end and a vertical dimension at its second end, and the vertical dimension of the first forming edge at its first end is greater than the vertical dimension at its second end, and the second forming edge of the second block splitter assembly has a vertical dimension at its first end and a vertical dimension at its second end, and the vertical dimension of the second forming edge at its first end is greater than the vertical dimension at its second end.

In an embodiment, the first forming edge of the first block splitter assembly has a vertical dimension at the midpoint between the first and second ends of the first block splitter assembly, and the vertical dimension of the first forming edge at its midpoint is greater than the vertical dimension at its second end, the second forming edge of the first block splitter assembly has a vertical dimension at the midpoint between the first and second ends of the first block splitter assembly, and the vertical dimension of the second forming edge at its midpoint is greater than the vertical dimension at its second end, the first forming edge of the second block splitter assembly has a vertical dimension at the midpoint between the first and second ends of the second block splitter assembly, and the vertical dimension of the first forming edge at its midpoint is greater than the vertical dimension at its second end, and the second forming edge of the second block splitter assembly has a vertical dimension at the midpoint between the first and second ends of the second block splitter assembly, and the vertical dimension of the second forming edge at its midpoint is greater than the vertical dimension at its second end.

In one embodiment, the first forming edge of the first block splitter assembly extends in an arc for at least a portion of a length from the first end to the second end of the first forming edge, the second forming edge of the first block splitter assembly extends in an arc for at least a portion of a length from the first end to the second end of the first forming edge, the first forming edge of the second block splitter assembly extends in an arc for at least a portion of a length from the first end to the second end of the first forming edge, and the second forming edge of the second block splitter assembly extends in an arc for at least a portion of a length from the first end to the second end of the first forming edge.

In an embodiment, the top surface of the first block splitter assembly further comprises a third forming edge having a length and extending at least the majority of the distance from the first end to the second end of the first block splitter assembly, the third forming edge having a first end and a second end, the first end of the third forming edge being disposed closer to the first end of the first block splitter assembly than the second end of the first block splitter assembly, the second end of the third forming edge being disposed closer to the second end of the first block splitter assembly than the first end of the first block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the top surface of the first block splitter assembly further comprises a fourth forming edge having a length and extending at least the majority of the distance from the first end to the second end of the first block splitter assembly, the fourth forming edge having a first end and a second end, the first end of the fourth forming edge being disposed closer to the second end of the first block splitter assembly than the first end of the first block splitter assembly, the second end of the fourth forming edge being disposed closer to the first end of the first block splitter assembly than the second end of the first block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge. The bottom surface of the second block splitter assembly further comprises a third forming edge having a length and extending at least the majority of the distance from the first end to the second end of the second block splitter assembly, the third forming edge having a first end and a second end, the first end of the third forming edge being disposed closer to the first end of the second block splitter assembly than the second end of the second block splitter assembly, the second end of the third forming edge being disposed closer to the second end of the second block splitter assembly than the first end of the second block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the bottom surface of the second block splitter assembly further comprises a fourth forming edge having a length and extending at least the majority of the distance from the first end to the second end of the second block splitter assembly, the fourth forming edge having a first end and a second end, the first end of the fourth forming edge being disposed closer to the second end of the second block splitter assembly than the first end of the second block splitter assembly, the second end of the fourth forming edge being disposed closer to the first end of the second block splitter assembly than the second end of the second block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge.

In an embodiment, the top surface of the first block splitter assembly comprises a first forming surface extending between the third forming edge and the first forming edge and a second forming surface extending between the fourth forming edge and the second forming edge, and the bottom surface of the second block splitter assembly comprises a first forming surface extending between the third forming edge and the first forming edge and a second forming surface extending between the fourth forming edge and the second forming edge. In one embodiment, the first and second splitter blade assemblies are identical. In an embodiment, the block splitter device further comprises first and second side knife assemblies.

The invention provides a method of producing a concrete block comprising: (i) providing a block splitter device comprising first lower and second upper opposed block splitter assemblies, (ii) placing a concrete workpiece in the block splitter device at a splitting position to be engaged by the first and second block splitter assemblies; and (iii) with the workpiece at the splitting position, activating the first and second block splitter assemblies to engage the workpiece and thereby split and form the workpiece. In an embodiment, the block produced by the method has a face and the face has a convex shape. In one embodiment, the block splitter assembly further comprises first and second side knife assemblies and the first and second side knife assemblies engage the workpiece at the same time that the first and second side knife assemblies engage the workpiece.

The block splitter device and assembly can be any block splitter device and assembly described herein.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A block splitter device comprising first lower and second upper opposed block splitter assemblies, the first block splitter assembly comprising a first end opposed from a second end, a first side surface opposed from a second side surface, a top surface, and a bottom surface, the top surface comprising: (i) a first forming edge extending at least the majority of the distance from the first end to the second end of the first block splitter assembly, the first forming edge having a first end and a second end, the first end of the first forming edge being disposed closer to the first end of the first block splitter assembly than the second end of the first block splitter assembly and being disposed near a median split plane, the median split plane being a reference plane that divides the top surface and the bottom surface of the first block splitter assembly in half and intersects a midpoint between the first and second side surfaces of the first end of the first block splitter assembly and intersects a midpoint between the first and second side surfaces of the second end of the first block splitter assembly, the second end of the first forming edge being disposed closer to the second end of the first block splitter assembly than the first end of the first block splitter assembly and being disposed further away from the median split plane than the first end of the first forming edge, and (ii) a second forming edge extending at least the majority of the distance from the first end to the second end of the first block splitter assembly, the second forming edge having a first end and a second end, the first end of the second forming edge being disposed closer to the second end of the first block splitter assembly than the first end of the first block splitter assembly and being disposed near the median split plane, the second end of the second forming edge being disposed closer to the first end of the first block splitter assembly than the second end of the first block splitter assembly and being disposed further away from the median split plane than the first end of the second forming edge, and the second block splitter assembly comprising a first end opposed from a second end, a first side surface opposed from a second side surface, a top surface, and a bottom surface, the bottom surface comprising: (i) a first forming edge extending at least the majority of the distance from the first end to the second end of the second block splitter assembly, the first forming edge having a first end and a second end, the first end of the first forming edge being disposed closer to the first end of the second block splitter assembly than the second end of the second block splitter assembly and being disposed near a median split plane, the median split plane being a reference plane that divides the top surface and the bottom surface of the second block splitter assembly in half and intersects a midpoint between the first and second side surfaces of the first end of the second block splitter assembly and intersects a midpoint between the first and second side surfaces of the second end of the second block splitter assembly, the second end of the first forming edge being disposed closer to the second end of the second block splitter assembly than the first end of the second block splitter assembly and being disposed further away from the median split plane than the first end of the first forming edge, and (ii) a second forming edge extending at least the majority of the distance from the first end to the second end of the second block splitter assembly, the second forming edge having a first end and a second end, the first end of the second forming edge being disposed closer to the second end of the second block splitter assembly than the first end of the second block splitter assembly and being disposed near the median split plane, the second end of the second forming edge being disposed closer to the first end of the second block splitter assembly than the second end of the second block splitter assembly and being disposed further away from the median split plane than the first end of the second forming edge.

2. The block splitter of claim 1, wherein in the first block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge, and in the second block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge.

3. The block splitter of claim 1, wherein the first and second forming edges of the first block splitter assembly do not intersect and the first and second forming edges of the second block splitter assembly do not intersect.

4. The block splitter device of claim 1, wherein the first and second forming edges of the first block splitter assembly extend the entire distance from the first end to the second end of the first block splitter assembly and the first and second forming edges of the second block splitter assembly extend the entire distance from the first end to the second end of the second block splitter assembly.

5. The block splitter device of claim 1, wherein the first and second forming edges of the first block splitter assembly and the first and second forming edges of the second block splitter assembly are not opposed to each other.

6. The block splitter device of claim 1, wherein the first forming edge of the first block splitter assembly has a vertical dimension at its first end and a vertical dimension at its second end, and the vertical dimension of the first forming edge at its first end is greater than the vertical dimension at its second end, the second forming edge of the first block splitter assembly has a vertical dimension at its first end and a vertical dimension at its second end, and the vertical dimension of the second forming edge at its first end is greater than the vertical dimension at its second end, the first forming edge of the second block splitter assembly has a vertical dimension at its first end and a vertical dimension at its second end, and the vertical dimension of the first forming edge at its first end is greater than the vertical dimension at its second end, and the second forming edge of the second block splitter assembly has a vertical dimension at its first end and a vertical dimension at its second end, and the vertical dimension of the second forming edge at its first end is greater than the vertical dimension at its second end.

7. The block splitter device of claim 6, wherein the first forming edge of the first block splitter assembly has a vertical dimension at the midpoint between the first and second ends of the first block splitter assembly, and the vertical dimension of the first forming edge at its midpoint is greater than the vertical dimension at its second end, the second forming edge of the first block splitter assembly has a vertical dimension at the midpoint between the first and second ends of the first block splitter assembly, and the vertical dimension of the second forming edge at its midpoint is greater than the vertical dimension at its second end, the first forming edge of the second block splitter assembly has a vertical dimension at the midpoint between the first and second ends of the second block splitter assembly, and the vertical dimension of the first forming edge at its midpoint is greater than the vertical dimension at its second end, and the second forming edge of the second block splitter assembly has a vertical dimension at the midpoint between the first and second ends of the second block splitter assembly, and the vertical dimension of the second forming edge at its midpoint is greater than the vertical dimension at its second end.

8. The block splitter device of claim 1, wherein the first forming edge of the first block splitter assembly extends in an arc for at least a portion of a length from the first end to the second end of the first forming edge, the second forming edge of the first block splitter assembly extends in an arc for at least a portion of a length from the first end to the second end of the first forming edge, the first forming edge of the second block splitter assembly extends in an arc for at least a portion of a length from the first end to the second end of the first forming edge, and the second forming edge of the second block splitter assembly extends in an arc for at least a portion of a length from the first end to the second end of the first forming edge.

9. The block splitter device of claim 1, wherein the top surface of the first block splitter assembly further comprises a third forming edge having a length and extending at least the majority of the distance from the first end to the second end of the first block splitter assembly, the third forming edge having a first end and a second end, the first end of the third forming edge being disposed closer to the first end of the first block splitter assembly than the second end of the first block splitter assembly, the second end of the third forming edge being disposed closer to the second end of the first block splitter assembly than the first end of the first block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the top surface of the first block splitter assembly further comprises a fourth forming edge having a length and extending at least the majority of the distance from the first end to the second end of the first block splitter assembly, the fourth forming edge having a first end and a second end, the first end of the fourth forming edge being disposed closer to the second end of the first block splitter assembly than the first end of the first block splitter assembly, the second end of the fourth forming edge being disposed closer to the first end of the first block splitter assembly than the second end of the first block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge, and the bottom surface of the second block splitter assembly further comprises a third forming edge having a length and extending at least the majority of the distance from the first end to the second end of the second block splitter assembly, the third forming edge having a first end and a second end, the first end of the third forming edge being disposed closer to the first end of the second block splitter assembly than the second end of the second block splitter assembly, the second end of the third forming edge being disposed closer to the second end of the second block splitter assembly than the first end of the second block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the bottom surface of the second block splitter assembly further comprises a fourth forming edge having a length and extending at least the majority of the distance from the first end to the second end of the second block splitter assembly, the fourth forming edge having a first end and a second end, the first end of the fourth forming edge being disposed closer to the second end of the second block splitter assembly than the first end of the second block splitter assembly, the second end of the fourth forming edge being disposed closer to the first end of the second block splitter assembly than the second end of the second block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge.

10. The block splitter device of claim 9, wherein the top surface of the first block splitter assembly comprises a first forming surface extending between the third forming edge and the first forming edge and a second forming surface extending between the fourth forming edge and the second forming edge, and the bottom surface of the second block splitter assembly comprises a first forming surface extending between the third forming edge and the first forming edge and a second forming surface extending between the fourth forming edge and the second forming edge.

11. The block splitter device of claim 1, wherein the first and second splitter blade assemblies are identical.

12. The block splitter device of claim 1, further comprising first and second side knife assemblies.

13. A method of producing a concrete block comprising:

(i) providing a block splitter assembly comprising first lower and second upper opposed splitter blade assemblies, the first block splitter assembly comprising a first end opposed from a second end, a first side surface opposed from a second side surface, a top surface, and a bottom surface, the top surface comprising: (i) a first forming edge extending at least the majority of the distance from the first end to the second end of the first block splitter assembly, the first forming edge having a first end and a second end, the first end of the first forming edge being disposed closer to the first end of the first block splitter assembly than the second end of the first block splitter assembly and being disposed near a median split plane, the median split plane being a reference plane that divides the top surface and the bottom surface of the first block splitter assembly in half and intersects a midpoint between the first and second side surfaces of the first end of the first block splitter assembly and intersects a midpoint between the first and second side surfaces of the second end of the first block splitter assembly, the second end of the first forming edge being disposed closer to the second end of the first block splitter assembly than the first end of the first block splitter assembly and being disposed further away from the median split plane than the first end of the first forming edge, and (ii) a second forming edge extending at least the majority of the distance from the first end to the second end of the first block splitter assembly, the second forming edge having a first end and a second end, the first end of the second forming edge being disposed closer to the second end of the first block splitter assembly than the first end of the first block splitter assembly and being disposed near the median split plane, the second end of the second forming edge being disposed closer to the first end of the first block splitter assembly than the second end of the first block splitter assembly and being disposed further away from the median split plane than the first end of the second forming edge, and the second block splitter assembly comprising a first end opposed from a second end, a first side surface opposed from a second side surface, a top surface, and a bottom surface, the bottom surface comprising: (i) a first forming edge extending at least the majority of the distance from the first end to the second end of the second block splitter assembly, the first forming edge having a first end and a second end, the first end of the first forming edge being disposed closer to the first end of the second block splitter assembly than the second end of the second block splitter assembly and being disposed near a median split plane, the median split plane being a reference plane that divides the top surface and the bottom surface of the second block splitter assembly in half and intersects a midpoint between the first and second side surfaces of the first end of the second block splitter assembly and intersects a midpoint between the first and second side surfaces of the second end of the second block splitter assembly, the second end of the first forming edge being disposed closer to the second end of the second block splitter assembly than the first end of the second block splitter assembly and being disposed further away from the median split plane than the first end of the first forming edge, and (ii) a second forming edge extending at least the majority of the distance from the first end to the second end of the second block splitter assembly, the second forming edge having a first end and a second end, the first end of the second forming edge being disposed closer to the second end of the second block splitter assembly than the first end of the second block splitter assembly and being disposed near the median split plane, the second end of the second forming edge being disposed closer to the first end of the second block splitter assembly than the second end of the second block splitter assembly and being disposed further away from the median split plane than the first end of the second forming edge;

(ii) placing a concrete workpiece in the block splitter assembly at a splitting position to be engaged by the first and second splitter blade assemblies; and (iii) with the workpiece at the splitting position, activating the first and second splitter blade assemblies to engage the workpiece and thereby split and form the workpiece.

14. The method of claim 13, wherein in the first block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge, and in the second block splitter assembly minimum distances between the first forming edge and the median split plane increase or remain constant over the entire length of the first forming edge from the first end to the second end of the first forming edge and minimum distances between the second forming edge and the median split plane increase or remain constant over the entire length of the second forming edge from the first end to the second end of the second forming edge.

15. The method of claim 13, wherein the first and second forming edges of the first block splitter assembly do not intersect and the first and second forming edges of the second block splitter assembly do not intersect.

16. The method of claim 13, wherein the first and second forming edges of the first block splitter assembly extend the entire distance from the first end to the second end of the first block splitter assembly and the first and second forming edges of the second block splitter assembly extend the entire distance from the first end to the second end of the second block splitter assembly.

17. The method of claim 13, wherein the first and second forming edges of the first block splitter assembly and the first and second forming edges of the second block splitter assembly are not opposed to each other.

18. The method of claim 13, wherein the first forming edge of the first block splitter assembly has a vertical dimension at its first end and a vertical dimension at its second end, and the vertical dimension of the first forming edge at its first end is greater than the vertical dimension at its second end, the second forming edge of the first block splitter assembly has a vertical dimension at its first end and a vertical dimension at its second end, and the vertical dimension of the second forming edge at its first end is greater than the vertical dimension at its second end, the first forming edge of the second block splitter assembly has a vertical dimension at its first end and a vertical dimension at its second end, and the vertical dimension of the first forming edge at its first end is greater than the vertical dimension at its second end, and the second forming edge of the second block splitter assembly has a vertical dimension at its first end and a vertical dimension at its second end, and the vertical dimension of the second forming edge at its first end is greater than the vertical dimension at its second end.

19. The method of claim 18, wherein the first forming edge of the first block splitter assembly has a vertical dimension at the midpoint between the first and second ends of the first block splitter assembly, and the vertical dimension of the first forming edge at its midpoint is greater than the vertical dimension at its second end, the second forming edge of the first block splitter assembly has a vertical dimension at the midpoint between the first and second ends of the first block splitter assembly, and the vertical dimension of the second forming edge at its midpoint is greater than the vertical dimension at its second end, the first forming edge of the second block splitter assembly has a vertical dimension at the midpoint between the first and second ends of the second block splitter assembly, and the vertical dimension of the first forming edge at its midpoint is greater than the vertical dimension at its second end, and the second forming edge of the second block splitter assembly has a vertical dimension at the midpoint between the first and second ends of the second block splitter assembly, and the vertical dimension of the second forming edge at its midpoint is greater than the vertical dimension at its second end.

20. The method of claim 13, wherein the first forming edge of the first block splitter assembly extends in an arc for at least a portion of a length from the first end to the second end of the first forming edge, the second forming edge of the first block splitter assembly extends in an arc for at least a portion of a length from the first end to the second end of the first forming edge, the first forming edge of the second block splitter assembly extends in an arc for at least a portion of a length from the first end to the second end of the first forming edge, and the second forming edge of the second block splitter assembly extends in an arc for at least a portion of a length from the first end to the second end of the first forming edge.

21. The method of claim 13, wherein the top surface of the first block splitter assembly further comprises a third forming edge having a length and extending at least the majority of the distance from the first end to the second end of the first block splitter assembly, the third forming edge having a first end and a second end, the first end of the third forming edge being disposed closer to the first end of the first block splitter assembly than the second end of the first block splitter assembly, the second end of the third forming edge being disposed closer to the second end of the first block splitter assembly than the first end of the first block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the top surface of the first block splitter assembly further comprises a fourth forming edge having a length and extending at least the majority of the distance from the first end to the second end of the first block splitter assembly, the fourth forming edge having a first end and a second end, the first end of the fourth forming edge being disposed closer to the second end of the first block splitter assembly than the first end of the first block splitter assembly, the second end of the fourth forming edge being disposed closer to the first end of the first block splitter assembly than the second end of the first block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge, and the bottom surface of the second block splitter assembly further comprises a third forming edge having a length and extending at least the majority of the distance from the first end to the second end of the second block splitter assembly, the third forming edge having a first end and a second end, the first end of the third forming edge being disposed closer to the first end of the second block splitter assembly than the second end of the second block splitter assembly, the second end of the third forming edge being disposed closer to the second end of the second block splitter assembly than the first end of the second block splitter assembly and being disposed closer to the median split plane than the first end of the third forming edge, the third forming edge being disposed further away from the median split plane than the first forming edge for at least a majority of the length of the third forming edge and the third forming edge being disposed further away from second forming edge than the first forming edge for at least a majority of the length of the third forming edge, and the bottom surface of the second block splitter assembly further comprises a fourth forming edge having a length and extending at least the majority of the distance from the first end to the second end of the second block splitter assembly, the fourth forming edge having a first end and a second end, the first end of the fourth forming edge being disposed closer to the second end of the second block splitter assembly than the first end of the second block splitter assembly, the second end of the fourth forming edge being disposed closer to the first end of the second block splitter assembly than the second end of the second block splitter assembly and being disposed closer to the median split plane than the first end of the fourth forming edge, the fourth forming edge being disposed further away from the median split plane than the second forming edge for at least a majority of the length of the fourth forming edge and the fourth forming edge being disposed further away from the first forming edge than the second forming edge for at least a majority of the length of the fourth forming edge and the fourth forming edge being disposed further away from the third forming edge than from both the first and second forming edges for at least a majority of the length of the fourth forming edge.

22. The method of claim 21, wherein the top surface of the first block splitter assembly comprises a forming surface extending between the third forming edge and the first forming edge and a forming surface extending between the fourth forming edge and the second forming edge, and the bottom surface of the second block splitter assembly comprises a forming surface extending between the third forming edge and the first forming edge and a forming surface extending between the fourth forming edge and the second forming edge.

23. The method of claim 13, wherein the first and second splitter blade assemblies are identical.

24. The method of claim 13, wherein the block produced by the method has a face and the face has a convex shape.

25. The method of claim 13, wherein the block splitter assembly further comprises first and second side knife assemblies and the first and second side knife assemblies engage the workpiece at the same time that the first and second side knife assemblies engage the workpiece.

* * * * *